United States Patent [19]

Gmeinder et al.

[11] Patent Number: 4,514,604

[45] Date of Patent: Apr. 30, 1985

[54] ARRANGEMENT FOR CONVERTING THE PRESSURE OF A MEDIUM INTO AN ELECTRICAL SIGNAL

[75] Inventors: Hermann Gmeinder, Warthausen-Oberhofen; Georg Wenger, Schemmerhofen, both of Fed. Rep. of Germany

[73] Assignee: Kaltenbach & Voigt GmbH & Co., Fed. Rep. of Germany

[21] Appl. No.: 631,012

[22] Filed: Jul. 17, 1984

Related U.S. Application Data

[63] Continuation of Ser. No. 478,526, filed as PCT EP 82/00151, Jul. 14, 1982, published as WO 83/00405, Feb. 3, 1983, § 102(e) date Mar. 16, 1983, abandoned.

[30] Foreign Application Priority Data

Jul. 17, 1981 [DE] Fed. Rep. of Germany ..... 3128408

[51] Int. Cl.[3] ..... H01H 35/34

[52] U.S. Cl. ..... 200/83 N

[58] Field of Search ..... 200/83 N, 83 B, 83 R, 200/83 A, 83 S, 83 SA, 5 A, 110 A

[56] References Cited

U.S. PATENT DOCUMENTS

| | | | |
|---|---|---|---|
| 1,958,297 | 5/1934 | Decker | 200/83 N |
| 2,916,577 | 12/1959 | Smith | 200/83 R |
| 3,267,233 | 8/1966 | Basile et al. | 200/83 N |
| 3,268,683 | 8/1966 | Palmer | 200/83 N |
| 3,433,912 | 3/1969 | Hutchison et al. | 200/83 R |
| 3,571,542 | 3/1971 | Madden et al. | 200/83 N |
| 3,673,369 | 6/1972 | Weaver | 200/83 B |
| 3,689,719 | 9/1972 | Phillips et al. | 200/83 N X |
| 3,754,106 | 8/1973 | MacDonald | 200/110 A X |
| 3,814,877 | 6/1974 | Alvarez | 200/83 N |
| 3,898,421 | 8/1975 | Suzumura | 200/5 A X |

FOREIGN PATENT DOCUMENTS

| | | |
|---|---|---|
| 2029981 | 12/1971 | Fed. Rep. of Germany . |
| 2031580 | 12/1971 | Fed. Rep. of Germany . |
| 2143014 | 2/1973 | France . |
| 2477710 | 3/1980 | France . |
| 83634 | 8/1971 | German Democratic Rep. . |
| 1161665 | 8/1969 | United Kingdom . |

OTHER PUBLICATIONS

R. W. Lomax, "The Design and Development of a Sealed Contact Change-over Diaphragm Relay", In: Proceedings of the 20th Relay Conference, Stillwater, Oklahoma, Apr. 18-19, 1972, pp. 7-1 to 7-8.

*Primary Examiner*—J. R. Scott

*Attorney, Agent, or Firm*—Scully, Scott, Murphy and Presser

[57] ABSTRACT

In an arrangement for converting the pressure of a pressure medium into an electrical signal, there is provided an electrical sensor 1, which is presently positionable into one of two fixed positions by a reciprocable adjusting element 3 through the alternating pressure of the pressure medium, under the concurrent electrical connection and disconnection of its contacts 4, 5. In order to maintain the constructional volume of the arrangement as well as the requirement of components as small as possible, the contacts 4, 5 of the sensor 1 are directly electrically connectible in one of the two fixed positions of the adjusting element 3.

14 Claims, 8 Drawing Figures

ARRANGEMENT FOR CONVERTING THE PRESSURE OF A MEDIUM INTO AN ELECTRICAL SIGNAL

This is a continuation of co-pending application Ser. No. 478,526 filed as PCT EP 82/00151, Jul. 14, 1982, published as WO 83/00405 Feb. 3, 1983, § 102(e) date Mar. 16, 1983, now abandoned.

BACKGROUND OF THE INVENTION

The present invention relates to an arrangement for the conversion of the pressure of a pressure medium, such as a fluid, for example gas, in particular air or liquid, especially water or a mixture forming a spray which is constituted of the two last-mentioned media, into an electrical signal; consisting of an electrical sensor such as a variable resistor and/or a switch; wherein the sensor is adapted to be brought into one of two set positions; for example, a switch into the switched-on position or the switched-off position, through the intermediary of an adjusting element which is reciprocable through the pressure of the pressure medium received from an actuatable and deactuatable pressure medium source, with a presently electrical connecting and disconnecting of the at least two contacts thereof.

Known from East German Pat. No. 83,634 are arrangements of the above-mentioned type in which the electrical sensor is constructed as a switch or microswitch and the adjusting element is constituted of a membrane, through which a control element projecting from the housing of the switch is placed into movement for purpose of connection or disconnection of its contacts, in effect for purpose of switching over from one set position into the other position. The extent of movement necessitated hereby, as well as the dimensions of the switch, require a relatively large switching hysteresis and a relatively large constructional volume for the arrangement, independent of the fact thereof that a switch, such as a microswitch with movable control element, component. A still larger constructional volume is obtained when, in accordance with German Published Patent Application Nos. 20 29 981 and 20 31 580, the membrane is in operative connection with the adjusting element of the electrical transmitter through a pressure plate and a resilient intermediate element which is supported against an abutment.

SUMMARY OF THE INVENTION

Accordingly, it is an object of the present invention to provide an arrangement of the above-mentioned type which evidences a minimal constructional volume and a minimal requirement of components.

The advantages which can be obtained by means of the invention can be essentially ascertained in that there is obviated a transmitter, or a switch having a control element which reciprocates from a housing; in contrast therewith, the transmitter can, in a simple manner, merely consist of contacts which are arranged in close proximity to the adjusting element in its position when it is not subjected to the pressure medium, which are connected in the usual manner with connector means, for example, each connected with a cable. Inasmuch as, for the connection of the contacts at the opposite side by means of the adjusting element, in particular for a fixed arrangement of the contacts, there is required only an extremely short path of movement of the adjusting element, there is obtained an extremely small constructional volume of the entire arrangement. In particular the constructional height can be maintained low.

Through the an elimination of the movable transmitter control element, not only is there reduced the constructional volume, but there is also achieved an extensively simplified construction of the arrangement.

Advantageous further modifications of the invention may be ascertained from the various drawings, and as elucidated hereinbelow.

BRIEF DESCRIPTION OF THE DRAWINGS

In the drawing there are illustrated exemplary embodiments of the invention.

There is illustrated.

DETAILED DESCRIPTION OF THE DRAWINGS

Figure 1:
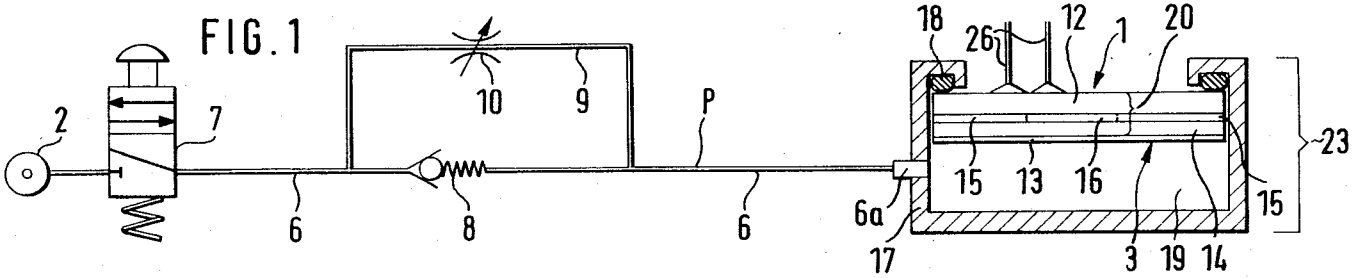
FIG. 1 shows the arrangement in a sectional view with the associated pressure medium source in a schematic representation.

The arrangement for the conversion of the pressure of the pressure medium into an electrical signal consists of an electrical sensor 1 which, by means of a movable adjusting element 3 which can be reciprocated through the action of a pressure medium received from a pressure medium source 2, for instance a compressor, under the respective electrical connection or disconnection of its contacts 4, 5 which, for example, consist of copper, into presently one of two fixed positions. The conduit conveying the pressure medium which is received from the pressure medium source 2 (FIG. 1), and which stands under a pressure P and serves for activation of the adjusting element 3, is designated with reference numeral 6. Built into the conduit 6 are also a two-way switch 7, for example, a foot-operated switch, for the activation or deactivation of the pressure medium infeed and a nonreturn value 8, with a bypass 9 encompassing the latter with a built-in throttle 10 for delaying the disconnection of the contacts 4, 5.

As more closely elucidated hereinbelow, the contacts 4, 5 of the transmitter 1 are directly electrically connectable in one fixed position of the adjusting element 3 through the last-mentioned.

Figure 2:
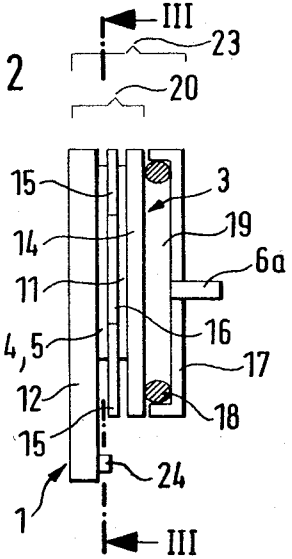
FIG. 2 is a sectional view of the arrangement modified in comparison with that shown in FIG. 1.
Figure 3:
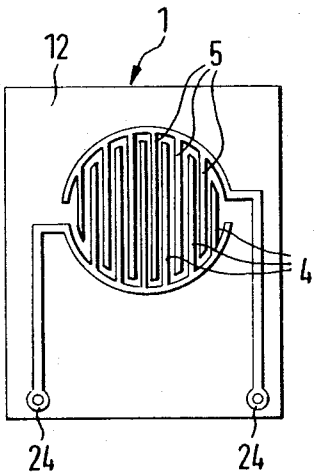
FIG. 3 is a sectional view taken along line III—III in FIG. 2.

In the embodiment pursuant to FIGS. 2 and 3, the side of the adjusting element 3 which comes into contact with the contacts 4, 5 of the sensor 1 is constituted of electrically-conductive material. For this purpose there is provided a layer 11 of electrically-conductive material, for example, copper, on the mentioned side of the adjusting element 3. However, the adjusting element 3 can also consist entirely of electrically-conductive material.

From the drawing there can be ascertained that the contacts 4, 5 are arranged in a stationary manner. For this purpose, for example, pursuant to FIGS. 2 and 3, the sensor 1 is constructed in the form of a plate 12 of electrically non-conductive material having contacts 4, 5 arranged on the side thereof facing towards the adjusting element 3. For example, pursuant to FIGS. 4 and 5 the contacts 4, 5 are positioned within the plate 12, wherein the contacts may be arranged in the manner of a printed circuit. In the embodiment pursuant to FIG. 3, the contacts 4, 5 are arranged form patterns which meanderingly interengage. In every instance the arrangement is such that the adjusting element 3 will, after its movement caused by the pressure medium, contact the contacts 4, 5 and to thereby cause an electrical connection of the contacts 4, 5.

In the embodiment pursuant to FIG. 1, on the side of the adjusting element 3 facing away from the sensor 1, there is also arranged a sealing cover foil 13.

Basically, a piston can be provided as the reciprocable adjusting element 3 which is subjected to the pressure medium. However, in order to maintain the constructional volume of the arrangement, or its constructional height particularly small, and to eliminate a resetting force or, in effect a resetting element for the piston, for example, a spring, in a manner as is known, the adjusting element 3 is constructed as a kind of a membrane 14 which is subjected to the pressure medium.

From FIGS. 1, 2, 4, 7 and 8 may be ascertained that in a kind of foil switch, an insulating plate 15 is located between the plate-shaped sensor 1 and the membrane 14, which in order to facilitate the contacting between the membrane 14 and the contacts 4, 5 caused by the action of the pressure medium, the sensor is provided with a through aperture 16. In the embodiments according to FIGS. 1 and 4, the membrane 14 and the insulating plate 15 are in a flat constructed membrane chamber 17 provided with a connecting member **6*a* for the pressure medium conduit 6, whereas in the embodiments according to FIGS. 2, 7 and 8, the membrane 14 is located on the rim 17*a* of the flat constructed membrane chamber 17. The membrane chamber 17 is sealed by means of one or more sealing rings 18 against the exit of pressure medium. The connection of the membrane chamber 17 with the plate-like sensor 1 is effected, in the embodiment according to FIG. 4, with the aid of screws 19, while in the remaining embodiments this connection can be effected through glueing. In FIG. 1 the components 1, 13, 14, 15 are previously introduced through snapping in into the membrane chamber 19, in which the components 1, 13, 14, 15 and/or 17** are constituted of flexible material.

In the embodiments according to FIGS. 1, 2, 7, 8 the membrane 14, the insulating plate 15 and the plate-like sensor 1 form a structural unit 20. Hereby the mentioned components 14, 15, and 1 of the structural unit can be held together, for example, through glueing.

It is also advantageous that, for example, pursuant to FIGS. 2, 4, 6, 7, 8, to combine a constructional unit 20 with the membrane chamber 17 into a structural component 23. Also this connection can be produced through glueing; however, it is possible to provide a threaded screw connection, for example, by means of the screws 21 visible in FIG. 4.

Figure 6:
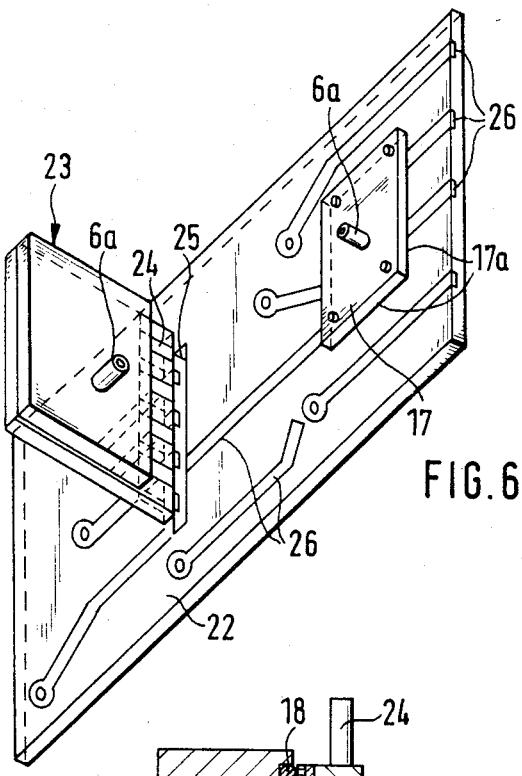
FIG. 6 illustrates capabilities for utilizing the arrangement in a perspective representation.

There can be provided one or more structural units 20, or as illustrated in FIG. 6 a unitary component 23 on one support plate 22. Serving this purpose are electrical plug contacts 24 which are arranged on the plate-shaped sensor 1 of the structural unit 20, or respectively the unitary component 23, and which serve for plugging into complementary socket elements 25 in the support plate 22. The socket elements 25 can be connected with electrical inlet and outlet conductors 26, for example in the form of printed circuits on the support plate 22. In the embodiment of FIG. 1, the inlet and outlet conductors 26 are constructed from single wires. Moreover, as may be further ascertained from FIG. 6, it is possible to locate the membrane chanber 17 alone on the support plate 22 so that, similar to FIG. 4, at least the sensor 1 is arranged in the support plate, and the insulating plate 15 as well as the membrane 14 are arranged in the membrane chamber. However, for example, besides the sensor 1, the insulating plate 15 can also be arranged in the support plate 22 and only the membrane 14 in the membrane chamber 17. Finally, it is also possible that, similar to FIG. 2, the sensor 1, insulating plate 15 and membrane 14 are combined in the support plate, whereby then only the membrane chamber 17 need have its rim **17*a* set onto the support plate 22 in a manner wherein the annular rim 17*a* encompasses the through aperture 16 of the insulating plate 15 which is located below the membrane 14**.

Figure 4:
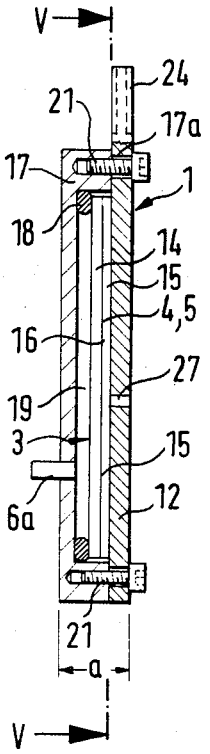
FIG. 4 is a further sectional view of an embodiment of the arrangement as modified in comparison with FIG. 1.
Figure 8:
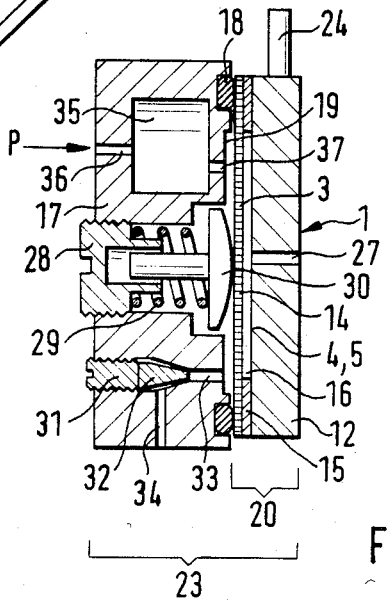
FIG. 8 is a further sectional view of a modified embodiment in comparison with FIG. 1 for the formation of a limit or threshold switch.
Figure 7:
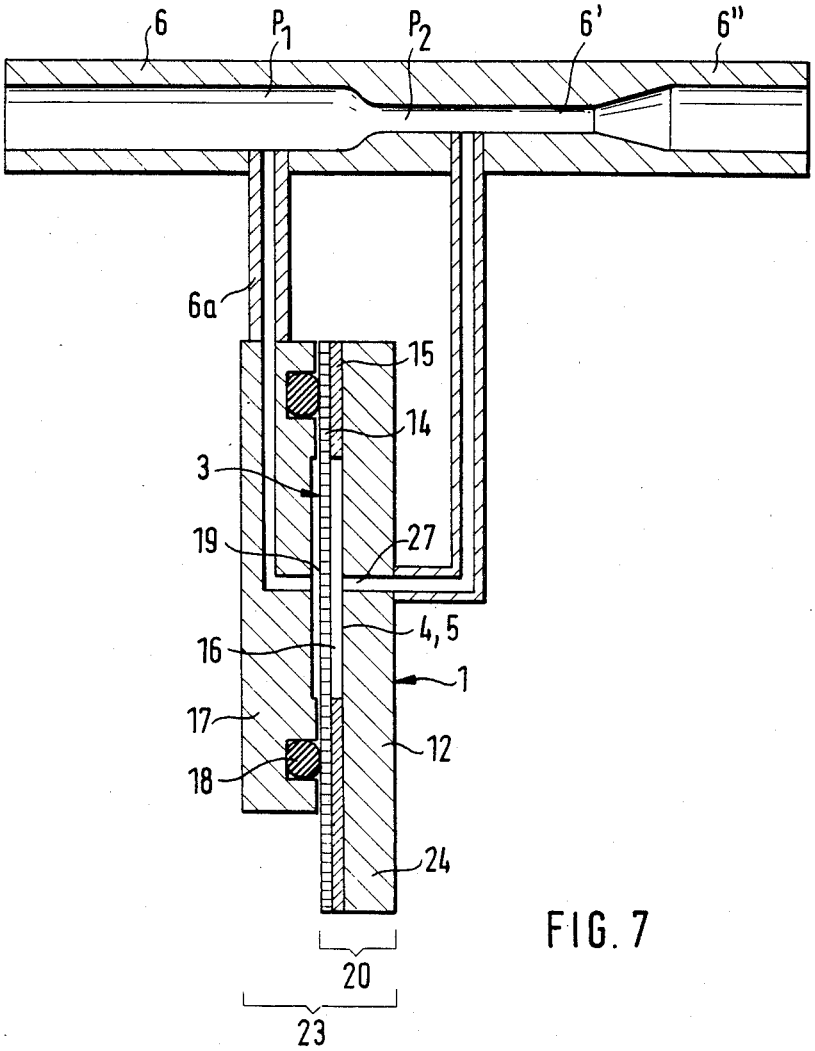
FIG. 7 is a further capability of utilization of the arrangement as a flow or differential pressure monitor in a sectional view.

For the venting of the space which is formed by the through aperture 16 between the plate-shaped sensor 1 and the membrane 14, in the embodiments according to FIGS. 4, 7 and 8, the plate-shaped sensor 1 is provided with an opening 27 passing through the plate 12.

In the embodiment according to FIG. 7, for the formation of a flow or differential pressure monitor, the opening 27 of the plate 12 communicates with a conduit section 6' which conveys a pressure medium which evidences a pressure P2 differentiating from the pressure P1 of the pressure medium flowing in the membrane chamber 19. The conduit section 6' which, for example, is a continuation of a conduit 6 conveying a dental spray, possesses a smaller cross-section than the conduit 6 and, in turn, is extended by a conduit section 6'' which has the same cross-section as the conduit 6.

In the embodiment according to FIG. 8, in order to change the pressure sensitivity of the membrane 14, arranged in the bottom of the membrane chamber 17 is an externally actuatable setting screw 28, against which there is supported a pressure spring 29 which, in turn, retains a pressure member 30 in contact with the membrane 14. Furthermore, from FIG. 8 there may be ascertained that arranged in the bottom of the membrane chanber 17 is an externally actuatable setting screw 31 for the setting of switching point and the switching hysteresis. The setting screw 31 has a conically reducing end 32 extending into a similarly conically reducing passageway 33 communicating with the membrane chamber 19, which includes a branch 34 communicting with the environment. Moreover, in the embodiment according to FIG. 8, in the bottom of the membrane chamber 17 there is also provided a pressure medium storage chamber 35, wherein the cross-section of the inlet opening 36 to the pressure medium storage chamber 35 is smaller then the cross-section of the outlet opening 37 communicating with the membrane chamber 19. The embodiment according to FIG. 8, which forms a so-called threshold trigger switch, is particularly adapted, as are also the other embodiments, for dental pressure media, such as cooling air, cooling water, a cooling spray which is formed by a mixture of air and water, turbine or air motor drive air or exhaust air for example, when during the deactivation or actuation of a dental treatment handpiece which is supplied with the pressure medium, there also be emitted an electrical signal in order to deactivate or activate the energy supply to another handpiece. Alternatively, upon switching off the pressure media supply to one handpiece, it may also be desirable to delay or switch off electrical energy to this handpiece, for instance for illuminating purposes.

The two-way switch 7 ascertainable in FIG. 1 for the activation in or deactivation of the pressure medium supply to the membrane chamber 19 can be constructed in the form of a volumetrically variably hollow member which can be operated by foot-pressure; for example, in accordance with German Laid-open Patent Application No. 15 66 281, in the form of an annular air sack of elastic material.

Figure 5:
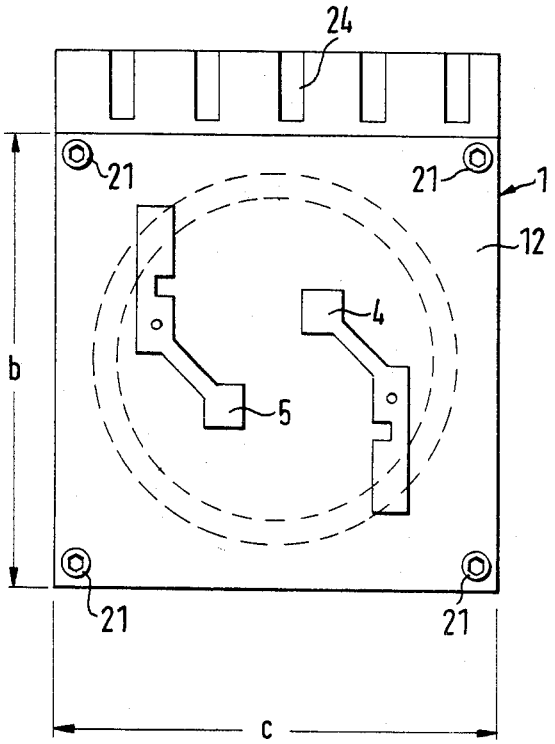
FIG. 5 is a sectional view taken along line V—V in FIG. 4.

The representation in the drawing is not true to scale so that, for example, in actuality the overall constructional height of the arrangement, in essence the dimension a in FIG. 4, from the outside of the bottom of the membrane chamber 17 to the outside of the plate-shaped sensor 1, is substantially smaller, for example 3 to 5 mm, whereas the width and the length of the arrangement, in essence the dimensions b and c in FIG. 5, can each consist of about 10 to 20 mm.

What is claimed:

1. A unitary component for converting the pressure of a pressure medium into an electrical signal, said unitary component forming a flat membrane chamber (17) having a plate (12) of electrically non-conductive material with electrical contacts (4,5) arranged on one side of the plate in the chamber, and a pressure responsive membrane (14), reciprocated through the pressure of a pressure medium received from a pressure medium source (2), having an electrically conductive surface facing said electrical contacts for the electrical connection and disconnection of contacts (4,5), and an insulating plate (15) located intermediate said plate and said membrane (14), said insulating plate including a through aperture (16) to allow the membrane (14) to contact the contacts (4,5) of the sensor therethrough under the pressure of the pressure medium.

2. Arrangement as claimed in claim 1, characterized in that the contacts (4,5) are arranged as a printed circuit formed on the surface of said plate.

3. Arrangement as claimed in 2, characterized in that the contacts (4,5) are arranged as meandering patterns on the surface of said plate.

4. Arrangement as claimed in claim 1, characterized in that the membrane chamber (17) is sealed by a sealing ring (18).

5. Arrangement as claimed in claim 1, characterized in that said insulating plate is provided with plug contacts (24).

6. Arrangement as claimed in claim 5, characterized in that one or more unitary components (23) are arranged to be supported on a support plate (22).

7. Arrangement as claimed in claim 6, characterized in that socket elements (25) in said support plate engage the plug contacts (24) in the support plate (22).

8. Arrangement as claimed in claim 7, characterized in that said insulating plate is provided with an opening (27) extending therethrough.

9. Arrangement as claimed in claim 8, characterized in that said opening (27) is connected with a conduit seciton (6') having a pressure (P2) differing from a pressure (P1) of a pressure medium flowing in the membrane chamber (19) for the formation of a flow or differential pre-sure monitor.

10. Arrangement as claimed in claim 8, characterized in that an externally actuatable setting screw (28) is located in the membrane chamber (17), a pressure spring (29) is supported against said screw, and said spring supports a pressure member (30) in contact with the membrane (14).

11. Arrangement as claimed in claim 8, characterized in that an externally actuatable setting screw (31) is arranged in the membrane chamber (17) for the setting of a switch point and switching hysteresis.

12. Arrangement as claimed in claim 11, characterized in that the setting screw (31) includes a conically reduced end (32) extending into a conically reduced passageway (33) communicating with the membrane chamber (19), which includes a branch (34) connecting with the environmental pressure.

13. Arrangement as claimed in claim 1, characterized in that a pressure medium storage chamber (35) is provided in the membrane chamber (17) to form a threshold trigger switch.

14. Arrangement as claimed in claim 13, characterized in that the cross-section of an inlet opening (36) of the pressure medium storage chamber (35) is smaller than the cross-section of an outlet opening (37) connecting into the membrane chamber (19).

* * * * *